US007434433B2

(12) United States Patent
Holmes

(10) Patent No.: US 7,434,433 B2
(45) Date of Patent: Oct. 14, 2008

(54) CURLING TOOL ASSEMBLY AND CURLING UNIT HAVING SAME

(75) Inventor: David Aaron Holmes, Dayton, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 0 days.

(21) Appl. No.: 11/546,822

(22) Filed: Oct. 12, 2006

(65) Prior Publication Data

US 2008/0087067 A1 Apr. 17, 2008

(51) Int. Cl.
*B21D 51/26* (2006.01)

(52) U.S. Cl. ..... 72/94; 72/93; 72/481.3

(58) Field of Classification Search ..... 72/379.4, 72/348, 68, 92, 93, 94, 336, 477, 478, 481.1
See application file for complete search history.

(56) References Cited

U.S. PATENT DOCUMENTS 1,622,540 A * 3/1927 Peters ..... 72/93
4,574,608 A 3/1986 Bulso, Jr. et al.
4,903,521 A 2/1990 Bulso, Jr. et al.
4,977,772 A 12/1990 Bulso, Jr. et al.
5,491,995 A 2/1996 Stodd
5,669,259 A 9/1997 Stodd
5,699,259 A * 12/1997 Colman et al. ..... 700/99
6,349,584 B1 * 2/2002 Kretz et al. ..... 72/93
6,766,677 B1 7/2004 Turnbull

* cited by examiner

*Primary Examiner*—Derris H. Banks
*Assistant Examiner*—Debra M Wolfe
(74) *Attorney, Agent, or Firm*—Grant E. Coffield; Eckert Seamans Cherin & Mellott, LLC

(57) ABSTRACT

The invention generally relates to a curling assembly for curling metal shells. The curling assembly has a shell support member having a flange extending from a foundation of the shell support member with the flange having a first aperture and a second aperture passing through the flange. An outer curler segment is coupled to the shell support member. An adjustment screw passes through the first aperture of the flange with the adjustment screw being structured to engage the outer curler segment. Actuation of the adjustment screw would position the outer curler segment. The second aperture of the flange is structured to receive a fastener for coupling the shell support member to a base of a curling unit. A curling unit for curling metal shells is also provided. A press in combination with a curling unit for curling metal shells is also provided.

20 Claims, 8 Drawing Sheets

CURLING TOOL ASSEMBLY AND CURLING UNIT HAVING SAME

FIELD OF THE INVENTION

The invention generally relates to a curling tool assembly. The invention also relates to a curling unit having a curling tool assembly.

BACKGROUND OF THE INVENTION

Multiple level curling tool assemblies of the type shown in U.S. Pat. Nos. 5,491,995 and 5,669,259 provides for up to three levels of curling tools to be coupled to each curling unit. Such designs reduce the number of curling units required for a shell press.

The design shown in U.S. Pat. Nos. 5,491,995 and 5,669,259 requires that each level of curling tools be assembled one on top of another in a tooling stack-up. Such an arrangement makes adjusting the curling tools at each level or changing the curling tools for different shell sizes more difficult on the bottom and the middle tool levels.

Accordingly, a need exists in the art for curling tool assemblies and curling units having same.

SUMMARY OF THE INVENTION

An object of the invention is to provide outer curler segments coupled to a shell support member in a curling tool assembly that can be easily coupled to a curling unit.

Another object of the invention is to provide outer curler segments coupled to a shell support member in a curling tool assembly that can be easily removed from a curling unit.

Another object of the invention is to provide outer curler segments coupled to a shell support member in a curling tool assembly that can be easily adjusted when coupled to a curling unit.

Certain objects of the invention are achieved by providing a curling assembly for curling metal shells. The curling assembly has a shell support member having a flange extending from a foundation of the shell support member with the flange having a first aperture and a second aperture passing through the flange. An outer curler segment is coupled to the shell support member. An adjustment screw passes through the first aperture of the flange with the adjustment screw being structured to engage the outer curler segment. Actuation of the adjustment screw would position the outer curler segment. The second aperture of the flange is structured to receive a fastener for coupling the shell support member to a base of a curling unit.

Other objects of the invention are achieved by providing a curling unit for curling metal shells. The curling unit has a shell support member having a flange extending from a foundation of the shell support member with the flange having a first aperture and a second aperture passing through the flange. An outer curler segment is coupled to the shell support member. An adjustment screw passes through the first aperture of the flange with the adjustment screw being structured to engage the outer curler segment. A base supports a shaft for rotation with the base having a rim portion with a planar surface extending along an entire top surface of the rim portion. A wheel is positioned above the base coupled to the shaft with the wheel having a lower flange portion. An inner curler segment is coupled to the lower flange portion in opposed relation to the outer curler segment. Actuation of the adjustment screw would position the outer curler segment. The second aperture of the flange receives a fastener for coupling the shell support member to the rim portion of the base and the inner curler segment and the corresponding outer curler segment define a lip curling station.

Other objects of the invention are achieved by providing a press in combination with a curling unit for curling metal shells. The combination has a tooling module for the manufacture of metal shells and a chute for conveying shells to the curling unit. A shell support member is provided having a flange extending from a foundation of the shell support member with the flange having a first aperture and a second aperture passing through the flange. An outer curler segment is coupled to the shell support member. An adjustment screw passes through the first aperture of the flange with the adjustment screw being structured to engage the outer curler segment. A base supports a shaft for rotation with the base having a rim portion with a planar surface extending along an entire top surface of the rim portion. A wheel is positioned above the base coupled to the shaft with the wheel having a lower flange portion. An inner curler segment is coupled to the lower flange portion in opposed relation to the outer curler segment. Actuation of the adjustment screw would position the outer curler segment. The second aperture of the flange receives a fastener for coupling the shell support member to the rim portion of the base and the inner curler segment and the corresponding outer curler segment define a lip curling station.

DETAILED DESCRIPTION OF THE PREFERRED EMBODIMENTS

Figure 1:
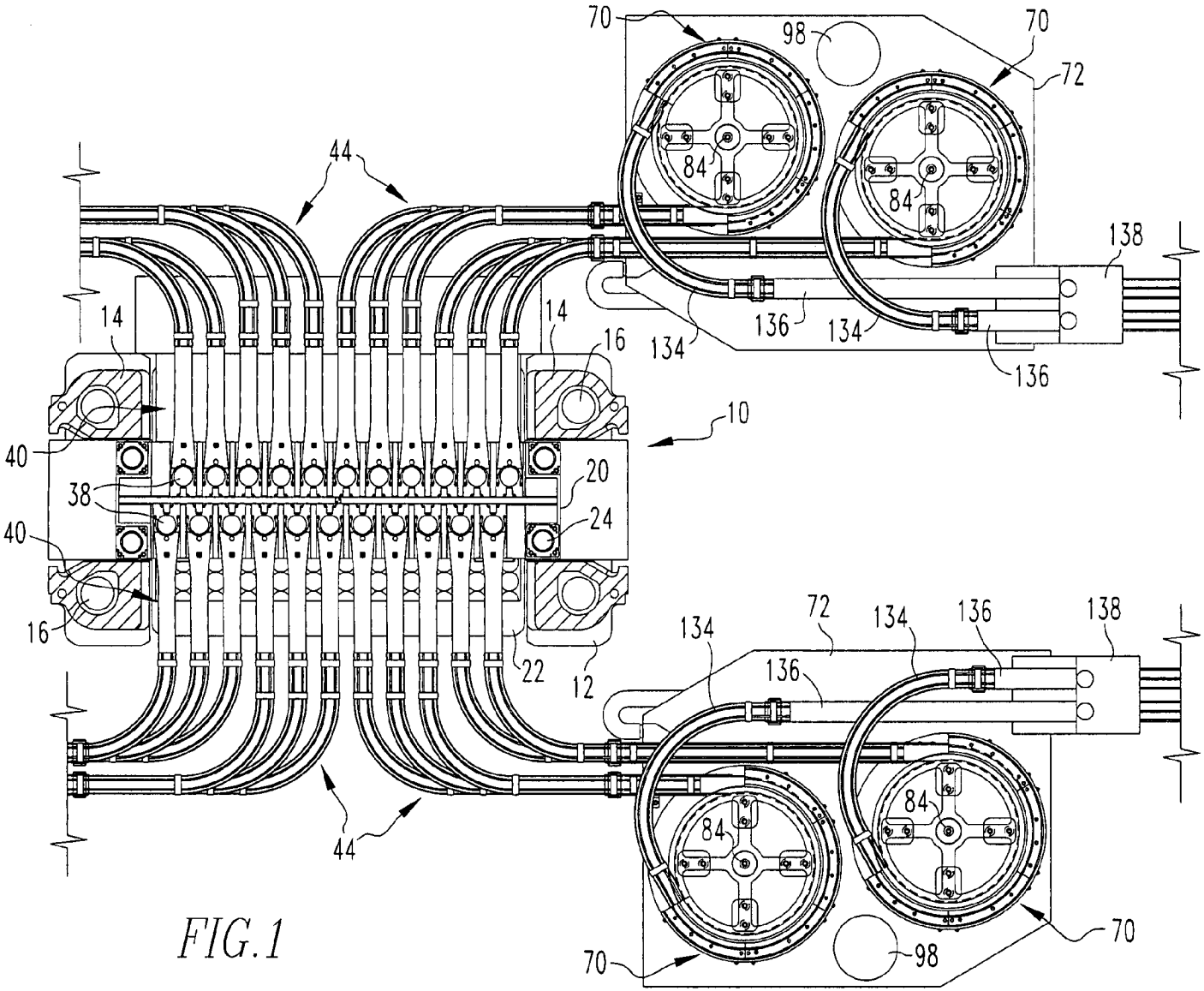
FIG. 1 is a diagrammatic plan view of shell forming tooling modules within a press and showing chutes which direct shells from both sides of the press to a set of curling units.

For purposes of the description hereinafter, the terms "upper", "lower", "vertical", "horizontal", "axial", "top", "bottom", "aft", "behind", and derivatives thereof shall relate to the invention, as it is oriented in the drawing FIGS. However, it is to be understood that the invention may assume various alternative configurations except where expressly specified to the contrary. It is also to be understood that the specific elements illustrated in the FIGS. and described in the following specification are simply exemplary embodiments of the invention. Therefore, specific dimensions, orientations and other physical characteristics related to the embodiments disclosed herein are not to be considered limiting.

As used herein, the term "fastener" means any suitable fastening, connecting or tightening mechanism such as dowel pins, fasteners, rivets, other connecting elements and the like. As used herein, the statement that two or more parts are "coupled" together means that the parts are joined together either directly or joined together indirectly through one or more intermediate parts.

Turning to FIG. 1, a press 10 includes a base 12 connected by columns 14 and tie rods 16 to an upper press frame (not shown). In alternate press configurations, the base may be connected by columns and socket head cap screws. In a conventional manner, the upper frame supports a movable horizontal platen (not shown) which reciprocates vertically in response to a rotary cam drive. An upper die shoe 18 (FIG. 2) is mounted on the vertically movable upper platen, and a lower die shoe 20 (FIG. 1) is mounted on a bolster plate 22 forming part of the base 12. A set of corner guide rods or pins 24 are secured to the lower die shoe 20 and project upwardly for receiving anti-friction tubular bearings mounted within the upper die shoe 18 to provide precision vertical movement for the upper die shoe 18 relative to the lower die shoe 20 with operation of the press 10.

Figure 2:
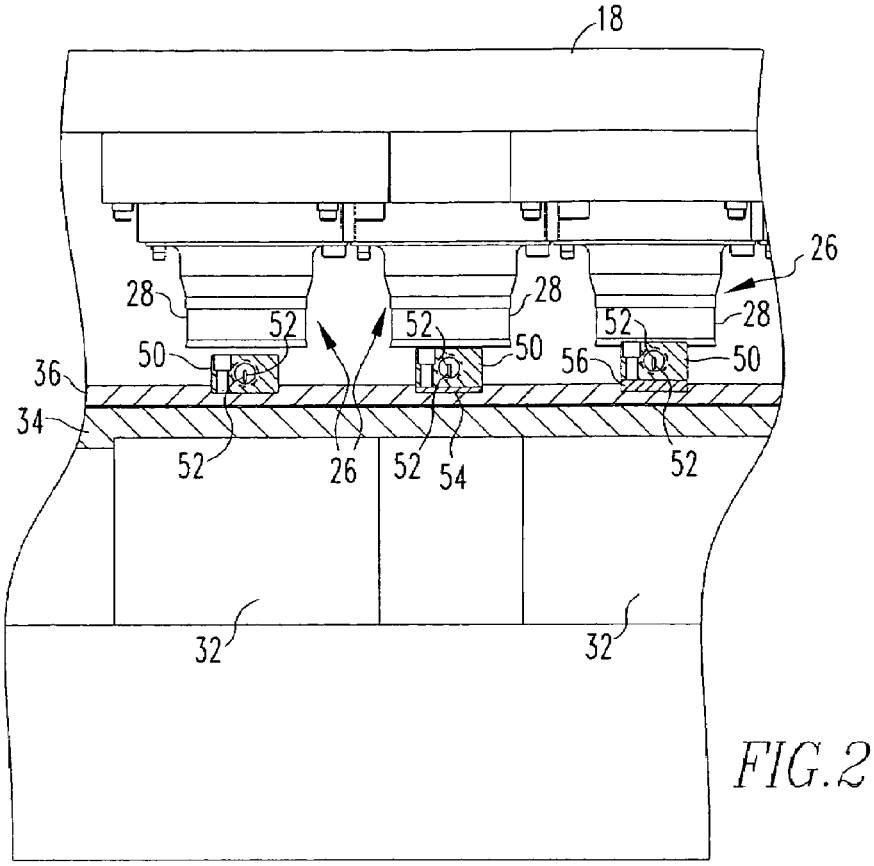
FIG. 2 is a fragmentary cross-sectional view of three tooling modules and showing air discharge passages for the tooling modules.

In the press 10 illustrated, the vertical movement or stroke of the upper die shoe 18 is about 1 ¾ inches and the press 10 is adapted to be operated at a relatively high speed, for example, on the order of 400 to 550 strokes per minute. The upper die shoe 18 and the lower die shoe 20 support two rows of tooling stations formed by horizontally spaced modular tooling components or tooling modules 26 (FIGS. 2 and 3).

Referring to FIG. 1, twenty two tooling modules 26 are arranged in two laterally spaced rows with each tooling module 26 including a blank and draw die 28 (FIGS. 2 and 3) carried by the upper die shoe 18 and an annular cut edge die 30 and die retainer 32 supported by the lower die shoe 20. A stock plate 34 (FIGS. 2 and 3) is also mounted on the lower die shoe 20 and supports a web or strip S of metal sheet which is fed into the press 10 laterally or perpendicular to the rows of tooling modules 26. A stripper plate 36 (FIGS. 2 and 3) holds the strip S downwardly against the stock plate 34 and defines a circular opening or pocket 38 (FIGS. 1 and 3) for each of the tooling modules 26.

Figure 3:
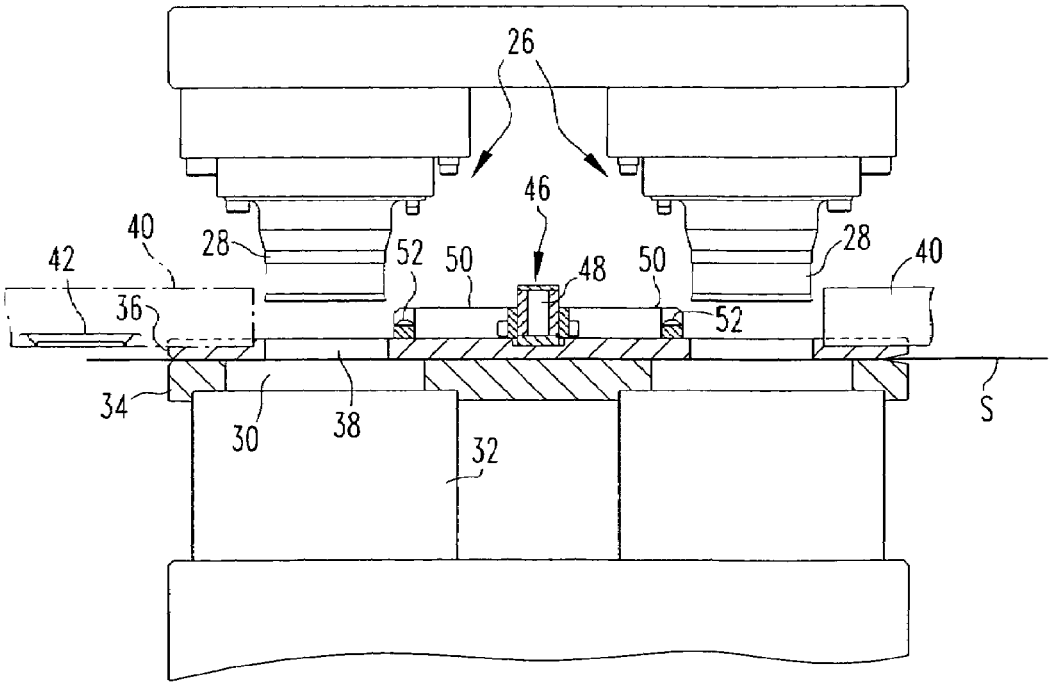
FIG. 3 is a fragmentary cross-sectional view of an air discharge passage, a tubular discharge chute and tooling modules.

As shown in FIG. 3, a tubular discharge chute 40 extends laterally outwardly from each of the tooling modules 26 for directing formed shells 42 from the tooling module 26 immediately after it is produced. As illustrated in FIG. 1, the conveyor or discharge chutes 40 extend outwardly towards opposite sides of the press 10 and are connected to corresponding tubular extension chutes 44 which curve so that eleven chutes 44 merge together and extend towards each end of the press 10 with five chutes 44 on one side of the press 10 and six chutes 44 on the opposite side of the press 10. While a "22 out" press 10 is shown for purposes of illustration, it is understood that more or less tooling modules 26 may be incorporated in the press 10 which may be a single action press with one reciprocating ram or a double action press with two reciprocating rams.

Referring to FIG. 3, an air ejector manifold 46 extends longitudinally from the press 10 on its center line and between the parallel rows of tooling modules 26 on top of the stripper plate 36. Pressurized air is supplied to the manifold 46 through a longitudinally extending chamber 48, and an ejector nozzle 50 projects laterally from the manifold 46 adjacent each of the tooling modules 26 and diametrically opposite the corresponding discharge chute 40 for the tooling module 26. An air discharge passage 52 directs a stream of air from the manifold 46 laterally below the corresponding blank and draw die 28 for ejecting each shell 42 into the discharge chute 40.

As shown in FIG. 2, the ejector nozzles 50 for each set of three successive chutes 44 are positioned at slightly different elevations by means of shim plates 54 and 56 so that the air discharge passage 52 for each set of three chutes 40 are at slightly different elevations. Thus, while the twenty two shells 42 are simultaneously produced with each stroke of the press 10, the shells 42 are ejected from the corresponding tooling modules 26 in slightly staggered timed relation. The air discharge passages 52 first eject the corresponding shells 42 as the blank and draw dies 28 are moving upwardly. The air discharge passage 52 above the shim plate 54 then ejects another group of shells 42, and these are followed by the shells 42 ejected by the air streams from the air discharge passage 52 above the shim plate 56.

Figure 6:
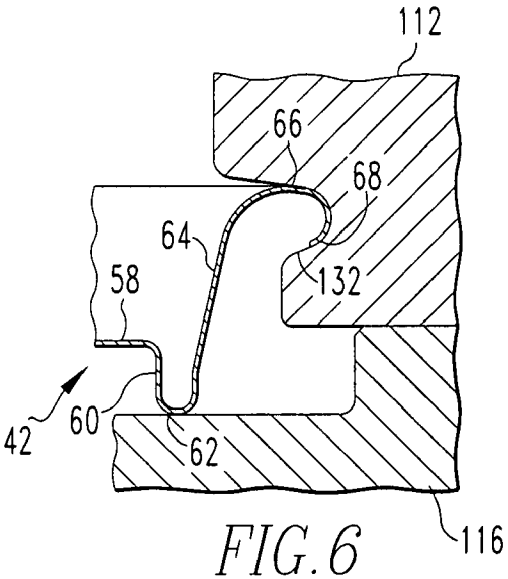
FIGS. 4-6 are fragmentary cross-sectional views of outer curler segments which illustrate the inward curling of the lip portion of a shell.
Figure 5:
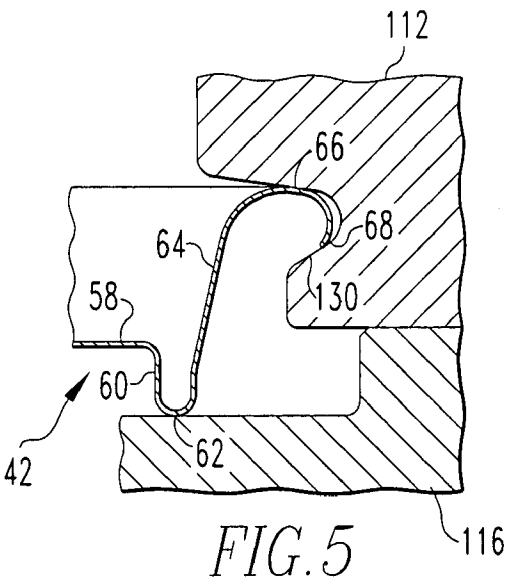
Figure 4:
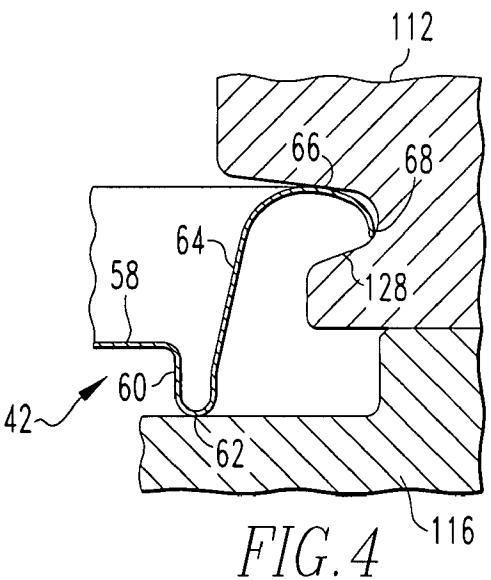

Referring to FIGS. 4-6, each of the shells 42 are formed from metal strip S having a thickness of about 0.0088 inch. Each shell 42 includes a flat circular center panel 58 which is connected by a substantially cylindrical panel wall 60 to an annular countersink portion 62 having a U-shaped cross-sectional configuration. A tapered or frustoconical chuckwall 64 connects the countersink portion 62 to a crown portion 66 which has a downwardly projecting peripheral lip portion 68.

The shells 42 are conveyed by air supplied from the air discharge passages 52 flowed within the chutes 40 and extension chutes 44 to a pair of rotary curling units 70 located at each corner of the press 10. The curling units 70 are effective to progressively roll or curl the lip portion 68 of each shell 42 inwardly to an undercut position as shown in FIGS. 4-6.

Each pair of rotary curling units 70 (FIG. 1) located at each corner of the press 10 is supported by an elevated platform 72, and each curling unit 70 is connected to two or three extension chutes 44 for successively receiving the shells 42 produced by the corresponding tooling modules 26 within the press 10.

Referring to FIGS. 7-11, since the curling units 70 are identical in construction, only one will be described in detail. Each curling unit 70 includes a base portion 74 which is coupled to the corresponding platform 72 by a set of fasteners (not shown). The base 74 includes a hub portion 76 which retains a pair of anti-friction bearings 77 coupled to a collar 79 for rotatably supporting a shaft 78. A curling wheel 80 is coupled to an upper end portion 82 of the shaft 78 and is secured by a fastener 84, a washer 86 and a key 88. The wheel 80 includes a rim portion 90 connected by an outwardly extending portion 94.

The shaft 78 also has a lower end portion 92 coupled to a bushing 95 which is coupled to a pulley 96. The wheels 80 of each pair of curling units 70 supported by each platform 72 are driven by an electric motor 98 (FIG. 1) supported by the platform 72. The motor 98 has a depending shaft (not shown) on which are mounted pulleys (not shown) coupled to pulleys 96 through suitable belts, linkages and the like for driving the pulleys 96 of the curling units 70.

Figure 7:
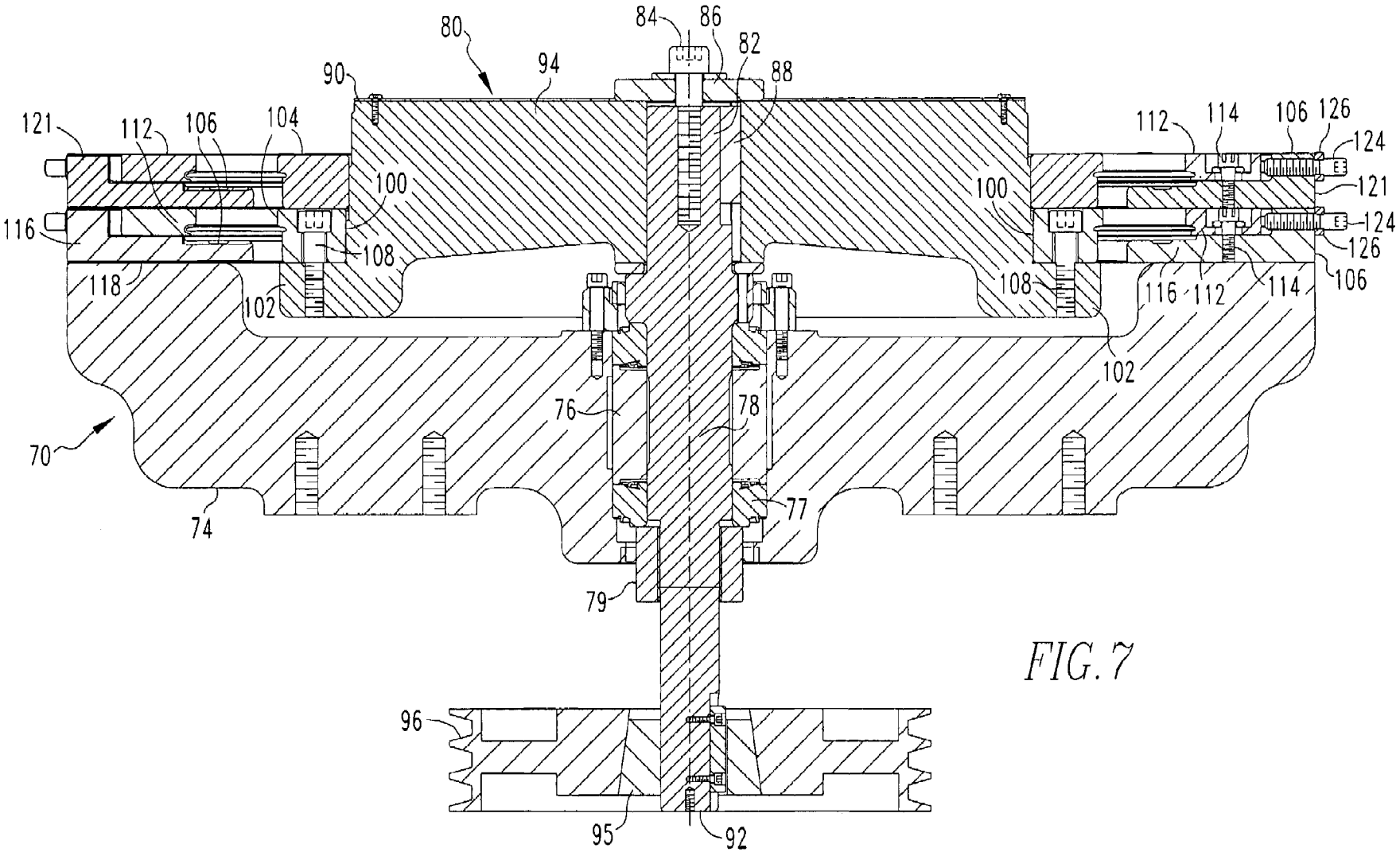
FIG. 7 is a cross-sectional view of a curling unit of the invention.
Figure 8:
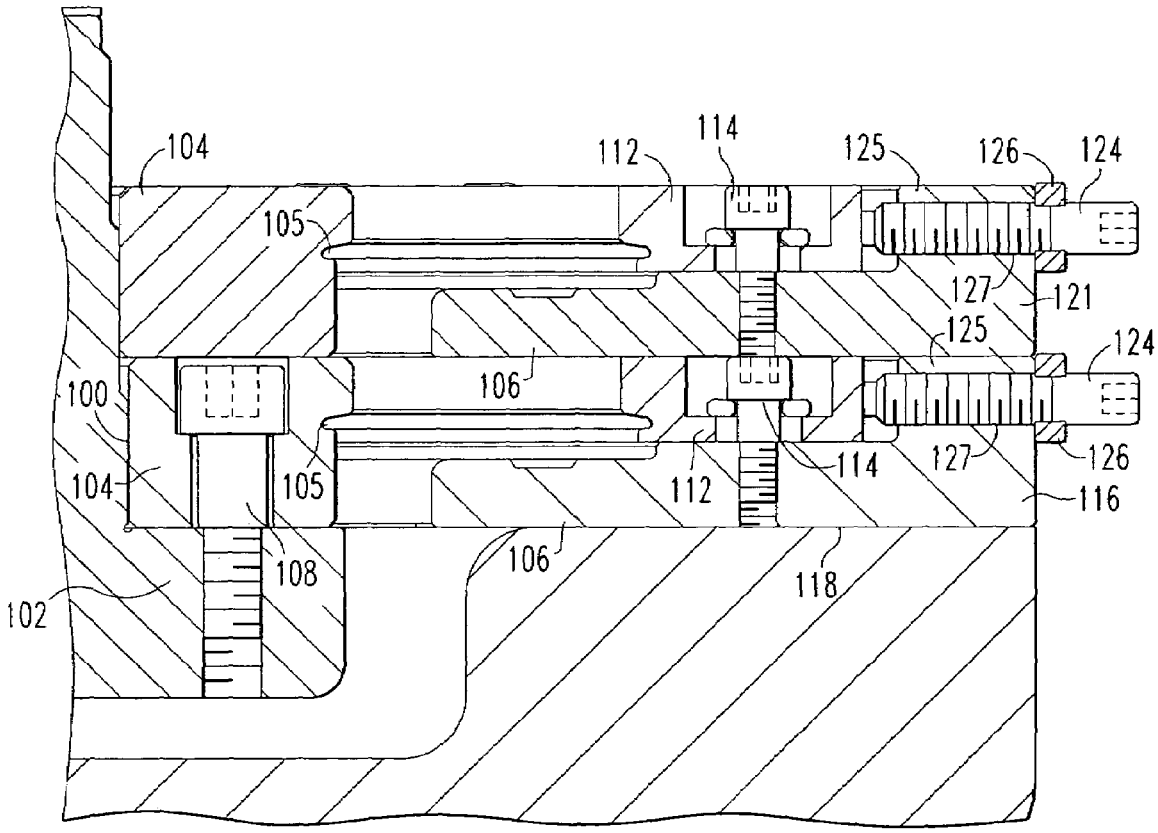
FIG. 8 is an enlarged cross-sectional view of the curling unit of FIG. 7 and illustrating the multiple level outer curler segments for inward curling of the lip portion of a shell.
Figure 9:
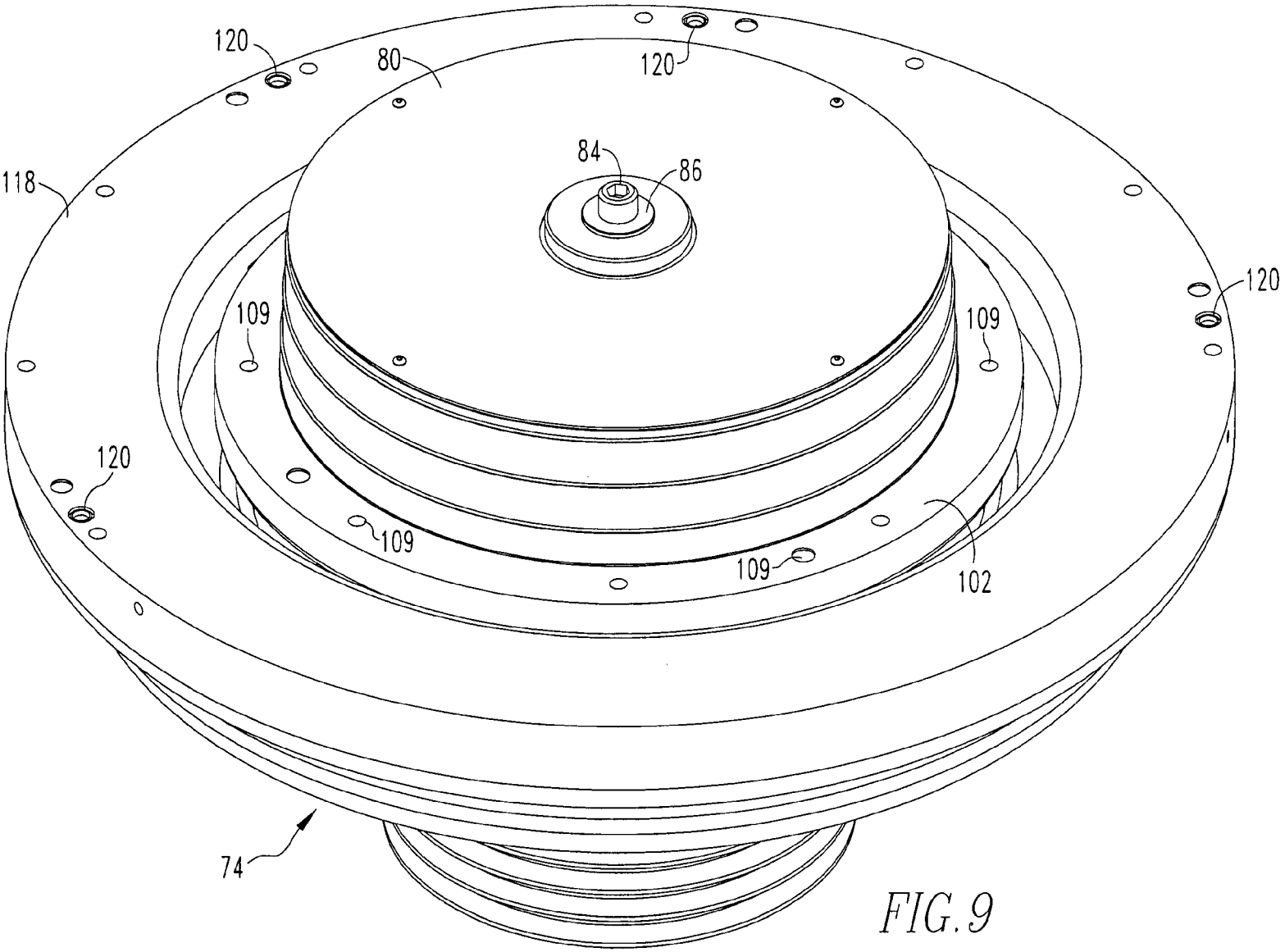
FIG. 9 is an isometric view of the curling unit with inner curler segments, shell support members and outer curler segments disconnected from the curling unit.

Referring to FIGS. 7 and 8, the rim portion 90 of each curling wheel 80 has a slightly stepped cylindrical outer surface 100 which projects above a lower flange portion 102. A set of inner curler segments 104 seat within and are coupled to the surface 100 or to other curler segments 104. Shell support members 106 are located proximate to the inner curler segments 104 for supporting shells 42 disposed within the curling units 70. The shell support members 106 are generally curved shaped rings, curve shaped ring segments or non-linear pieces of metal that may be coupled to the base 74 or to other shell support members 106. Fasteners 108 extend through apertures within the inner curler segments 104 and are threaded into apertures 109 (FIG. 9) provided on the lower flange portion 102 of the curling wheel 80 for coupling the inner curler segments 104 to the curling wheel 80 (FIGS. 7-8 and 10).

Each of the inner curler segments 104 has a peripherally extending uniform groove 105 which is contoured to receive the crown portion 66 and lip portion 68 of the shells 42 which are fed successively to each shell support member 106 of each curling unit 70. As shown in FIG. 1, the extension chutes 44 for two or three tooling modules 26 extend to each of the curling units 70 with two or three chutes 44 spaced vertically. The shells 42 flowing successively through the chutes 44 are fed into the curling unit 70 at different levels so that the shells 42 flowing within each chute 44 are received by the corresponding shell support member 106. As displayed in FIGS. 7-8 and 10-11, two shell support members 106 are generally shown, but any number of shell support members 106 may be used and the display of two shell support members 106 should not be construed as a limitation of the invention. Also, the generally curved ring, curved ring segment, or non-linear shape of the shell support members 106 could be divided, for example, into halves, thirds or the like and should not be considered a limitation of the invention as well.

Figure 10:
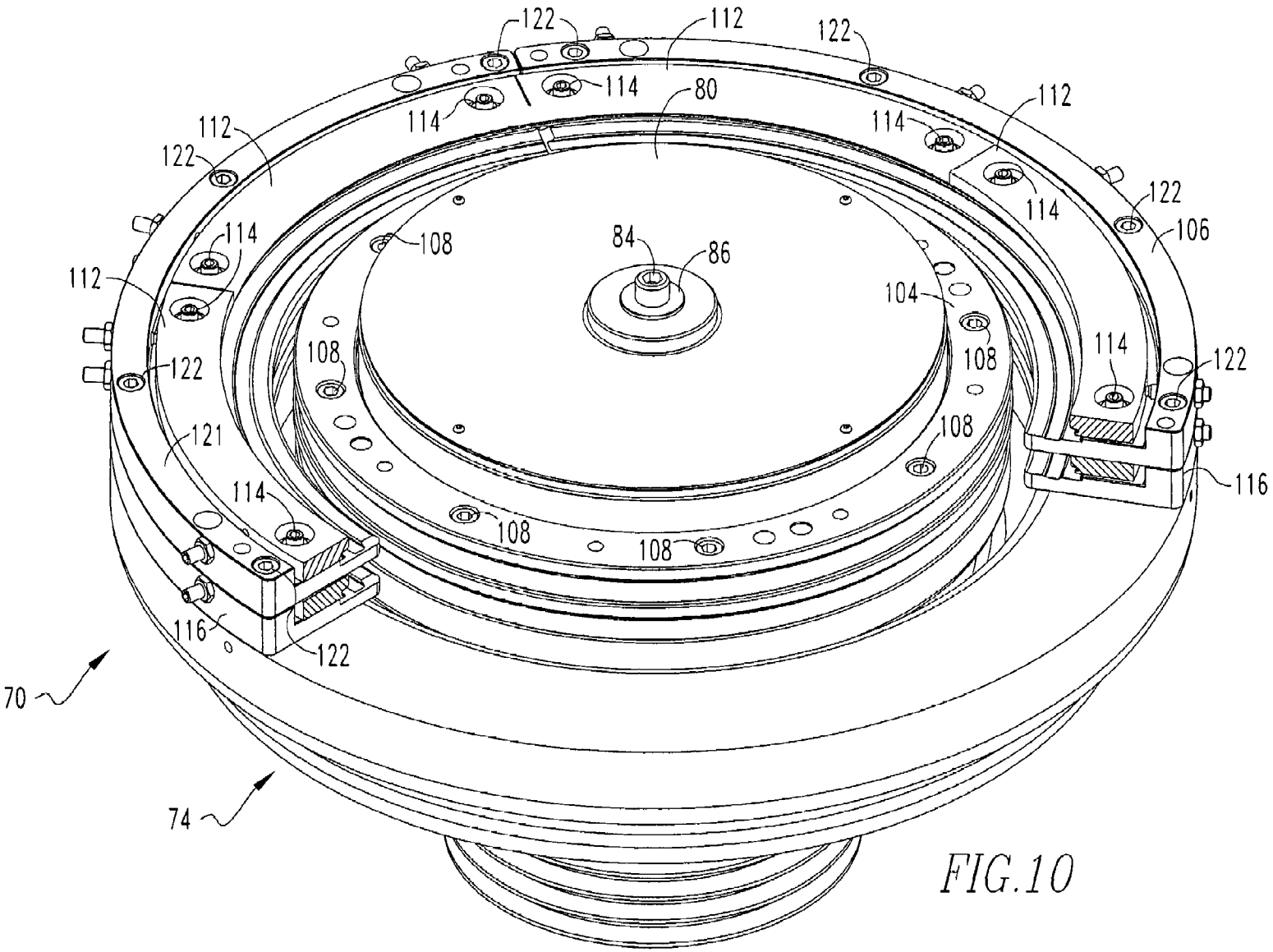
FIG. 10 is an isometric view of the curling unit with inner curler segments, shell support members and outer curler segments coupled to the curling unit.
Figure 11:
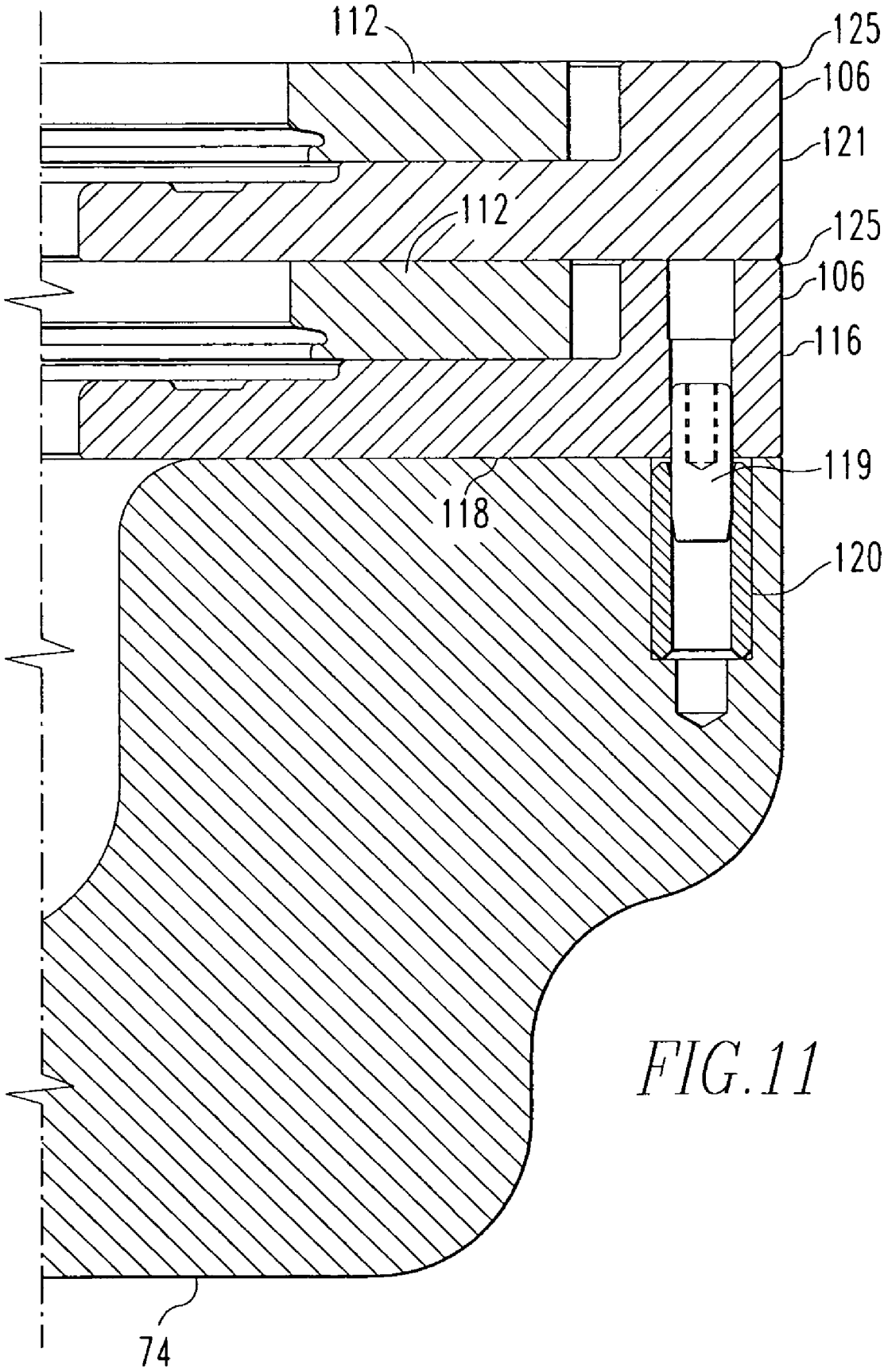
FIG. 11 is an enlarged cross-sectional view of the curling unit of FIG. 7 and illustrating the shell support member coupled to the base.

Referring to FIGS. 7-8 and 10-11, the tooling for each curling unit 70 also includes a number of outer curler segments 112 for opposing each of the inner curler segments 104 at each level thereby defining a plurality of lip curling stations at each level. Each of the outer curler segments 112 are secured to a shell support member 106 by a number of fasteners 114. In the invention, first shell support members 116 with certain outer curler segments 112 affixed thereto are advantageously removably coupled to a rim portion 118 of the base 74 by the use of fasteners 119 (FIG. 11) for engaging apertures 120 disposed in the rim portion 118 of the base 74. The rim portion 118 has a generally planar surface along the entire top surface in order to allow for coupling the first shell support members 116 to the base and to allow for the stacking of one shell support member 106 on top of another in a coupled relation as shown in FIG. 10. Second shell support members 121 with certain outer curler segments 112 affixed thereto are advantageously removably coupled to the first shell support members 116 by the use of fasteners 122 (FIG. 10). As can be seen in FIG. 8, the shell support members 106 have a general L-shaped configuration in cross-section. The shell support members 106 are generally curved shaped rings, curved shaped ring segments, or non-linear pieces of metal. With reference to FIG. 10, first shell support members 116 may be easily coupled to or easily removed from the rim portion 118 by removing or releasing fasteners 119 coupled to the rim portion 118 of the base 74 and the second shell support members 121 may be placed on top of first shell support members 116 secured to the rim portion 118 which second shell support members 121 may be easily coupled or easily removed by securing or releasing fasteners 122 coupled to the first shell support members 116.

A series of peripherally spaced adjustment screws 124 project radially inwardly through a first aperture that passes through an outwardly extending flange 125 of the shell support members 106 and engage the outer curler segments 112 at each level for precisely positioning each set of ring segments in a radial direction before the first shell support member 116 is secured to the base 74 or the second shell support member 121 is secured to the first shell support member 116. The flange 125 of the shell support member 106 extends from a foundation of the shell support member 106. A first axis passing through a length of the flange 125 may have an angle of about 80 degrees to 100 degrees relative to a second axis passing through a length of the foundation. The first axis may be generally perpendicular to the second axis. As can be seen, the foundation also has a recess disposed along a portion of the foundation. The flange 125 also has a second aperture that passes through the flange 125 where the fastener 119 is received for coupling shell support member 106 to the base 74 or to another shell support member 106. Lock nuts 126 secure the screws 124 after they are set. Fasteners 119 and 122 pass vertically through flange 125. The configuration of the shell support members 106 allow the shell support members 106 with outer curler segments 112 coupled thereto to be easily coupled to the curling unit 70 and easily removed from the curling unit 70 which avoids the problems associated with outer curler segments stacked-up one on top of another. Once the shell support members 106 are removed from the curling unit 70, one may couple different shell support members 106 to the curling unit 70 which may hold outer curler segments 112 with different sized diameters from the outer curler segments 112 held by the shell support members 106 that were removed from the curling unit 70. Also, the general L-shaped configuration of the shell support members 106 in cross-section allows such components to readily stack on top of each other when coupled to the curling unit 70 and permits simplified removal of certain shell support members 106 in the event, for example, the first shell support member 116 coupled to the base 74 needs to be accessed for adjustment. Additionally, the flange 125 of each shell support member 106 contains aperture 127 which receives the adjustment screw 124 for precise radial positioning of the outer curler segments 112.

Referring to FIGS. 4-6, the outer curler segments 112 at each level have inner peripherally extending grooves 128, 130 and 132 which gradually change in cross-sectional configuration for curling the lip portions 68 of the shells 42 inwardly. The shells 42 are rolled between the inner curler segments 104 and the outer curler segments 112 in response to rotation of the wheel 80 and while the shells 42 are supported at the multiple levels by the shell support members 106.

After the lip portions 68 of the shells 42 are curled inwardly by the curling units 70, the shells 42 are successively discharged or propelled from the curling units 70 and are directed through curved tubular guide chutes 134 (FIG. 1) and tubular extension chutes 136 to an air or vacuum driven downstacker 138. Each downstacker 138 collects the shells 42 from all three levels of each curling unit 70 and stacks the shells 42 in a vertical stack.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended hereto and any and all equivalents thereto.

What is claimed is:

1. A curling assembly for curling metal shells, the curling assembly comprising:

a shell support member having a flange extending from a foundation of the shell support member, the flange having a first aperture and a second aperture passing through the flange, the foundation of the shell support member being structured to engage and support the metal shells, an outer curler segment coupled to the shell support member, an adjustment screw passing through the first aperture of the flange with the adjustment screw being structured to engage the outer curler segment, wherein actuation of the adjustment screw would position the outer curler segment, wherein the second aperture of the flange of said shell support is structured to receive a fastener for removably coupling the shell support member to a base of a curling unit, and wherein the first aperture of the flange and the corresponding adjustment screw passing through the first aperture are perpendicular with respect to the second aperture of the flange and the corresponding fastener removably coupling the shell support member to the base.

2. The curling assembly of claim 1, further comprising an inner curler segment mounted in opposed relation to the outer curler segment with the inner curler segment and the corresponding outer curler segment defining a lip curling station.

3. The curling assembly of claim 1, wherein the base includes a rim portion with a planar surface extending along an entire top surface of the rim portion for coupling the shell support member to the base.

4. The curling assembly of claim 1, wherein the shell support member has a generally L-shaped configuration in cross section.

5. The curling assembly of claim 4, wherein the shell support member has a recess disposed along the foundation.

6. The curling assembly of claim 1, wherein the base supports a shaft for rotation, wherein a wheel is positioned above the base and is coupled to the shaft, wherein the wheel has a lower flange portion to which an inner curler segment is coupled in opposed relation to the outer curler segment, wherein the base includes a rim portion with a planar surface extending along an entire top surface of the rim portion, wherein the shell support member is coupled to the rim portion of the base, and wherein the inner curler segment and the corresponding outer curler segment define a lip curling station.

7. The curling assembly of claim 1 in combination with a press.

8. The curling assembly of claim 1 in combination with a curling unit.

9. The curling assembly of claim 1, wherein a plurality of shell support members, a plurality of outer curler segments, a plurality of inner curler segments and a plurality of adjustment screws are provided, wherein one of each of the plurality of inner curler segments is provided in opposed relation to one of each of the plurality of outer curler segments defining a plurality of lip curling stations, wherein one of each of the plurality of shell support members is provided with one of the plurality of outer curler segments coupled thereto yielding a plurality of assemblies, wherein the plurality of assemblies are stacked one on top of another in a coupled relation, and wherein the plurality of inner curler segments are stacked one on top of another in a coupled relation.

10. A curling unit for curling metal shells, the curling unit comprising:

a shell support member having a flange extending from a foundation of the shell support member, the flange having a first aperture and a second aperture passing through the flange, the foundation of the shell support member being structured to engage and support the metal shells, an outer curler segment coupled to the shell support member, an adjustment screw passing through the first aperture of the flange with the adjustment screw being structured to engage the outer curler segment, a base supporting a shaft for rotation, the base having a rim portion with a planar surface extending along an entire top surface of the rim portion;

a wheel positioned above the base coupled to the shaft, the wheel having a lower flange portion;

an inner curler segment coupled to the lower flange portion in opposed relation to the outer curler segment, wherein actuation of the adjustment screw would position the outer curler segment, wherein the second aperture of the flange of said shell support receives a fastener for removably coupling the shell support member to the rim portion of the base, wherein the inner curler segment and the corresponding outer curler segment define a lip curling station, and wherein the first aperture of the flange and the corresponding adjustment screw passing through the first aperture are perpendicular with respect to the second aperture of the flange and the corresponding fastener removably coupling the shell support member to the base.

11. The curling unit of claim 10, wherein the shell support member has a generally L-shaped configuration in cross section.

12. The curling unit of claim 11, wherein the shell support member has a recess disposed along the foundation.

13. The curling unit of claim 10 in combination with a press.

14. The curling unit of claim 10, wherein a plurality of shell support members, a plurality of outer curler segments, a plurality of inner curler segments and a plurality of adjustment screws are provided, wherein one of each of the plurality of inner curler segments is provided in opposed relation to one of each of the plurality of outer curler segments defining a plurality of lip curling stations, wherein one of each of the plurality of shell support members is provided with one of the plurality of outer curler segments coupled thereto yielding a plurality of assemblies, wherein the plurality of assemblies are stacked one on top of another in a coupled relation, and wherein the plurality of inner curler segments are stacked one on top of another in a coupled relation.

15. A press in combination with a curling unit for curling metal shells, the combination comprising:

a tooling module for the manufacture of metal shells;

a chute for conveying shells to the curling unit;

a shell support member having a flange extending from a foundation of the shell support member, the flange having a first aperture and a second aperture passing through the flange, the foundation of the shell support member engaging and supporting the metal shells, an outer curler segment coupled to the shell support member, an adjustment screw passing through the first aperture of the flange with the adjustment screw being structured to engage the outer curler segment, a base supporting a shaft for rotation, the base having a rim portion with a planar surface extending along an entire top surface of the rim portion;

a wheel positioned above the base coupled to the shaft, the wheel having a lower flange portion;

an inner curler segment coupled to the lower flange portion in opposed relation to the outer curler segment, wherein actuation of the adjustment screw would position the outer curler segment, wherein the second aperture of the flange of said shell support receives a fastener for removably coupling the shell support member to the rim portion of the base, wherein the inner curler segment and the corresponding outer curler segment define a lip curling station, and wherein the first aperture of the flange and the corresponding adjustment screw passing through the first aperture are perpendicular with respect to the second aperture of the flange and the corresponding fastener removably coupling the shell support member to the base.

16. The combination of claim 15, wherein the shell support member has a generally L-shaped configuration in cross section.

17. The combination of claim 16, wherein the shell support member has a recess disposed along the foundation.

18. The combination of claim 15, wherein a plurality of shell support members, a plurality of outer curler segments, a plurality of inner curler segments and a plurality of adjustment screws are provided, wherein one of each of the plurality of inner curler segments is provided in opposed relation to one of each of the plurality of outer curler segments defining a plurality of lip curling stations, wherein one of each of the plurality of shell support members is provided with one of the plurality of outer curler segments coupled thereto yielding a plurality of assemblies, wherein the plurality of assemblies are stacked one on top of another in a coupled relation, and wherein the plurality of inner curler segments are stacked one on top of another in a coupled relation.

19. The combination of claim 18, wherein a plurality of chutes are provided that convey shells to the curling unit.

20. The combination of claim 15, wherein a plurality of curling units are provided.

* * * * *